US006539561B2

(12) United States Patent
Shimizu

(10) Patent No.: US 6,539,561 B2
(45) Date of Patent: Apr. 1, 2003

(54) BATH TAB WITH BUILT-IN ILLUMINATION DEVICE

(76) Inventor: Hideo Shimizu, 26-26, Minami-Otsuka 1-Chome, Toshima-Ku, Tokyo (JP)

( * ) Notice: Subject to any disclaimer, the term of this patent is extended or adjusted under 35 U.S.C. 154(b) by 0 days.

(21) Appl. No.: 09/960,804

(22) Filed: Sep. 21, 2001

(65) Prior Publication Data

US 2002/0166163 A1 Nov. 14, 2002

(30) Foreign Application Priority Data

May 9, 2001 (JP) ..... 2001-138269

(51) Int. Cl.[7] ..... A47K 3/02

(52) U.S. Cl. ..... 4/559; 4/575.1; 4/577.1; 4/584; 362/101

(58) Field of Search ..... 4/541.1, 584, 592, 4/593, 546, 559; 362/101

(56) References Cited

U.S. PATENT DOCUMENTS

| | | | | |
|---|---|---|---|---|
| 2,604,579 A | * | 7/1952 | Deneboudes | 362/101 |
| 3,585,991 A | * | 6/1971 | Balamuth | 4/541.1 X |
| 3,788,306 A | * | 1/1974 | Eberhard | 4/584 X |
| 4,364,132 A | * | 12/1982 | Robinson | 4/546 |
| 4,535,489 A | * | 8/1985 | Elkins | 4/546 |
| 5,553,735 A | * | 9/1996 | Kimura | 362/101 |

* cited by examiner

*Primary Examiner*—Robert M. Fetsuga
(74) *Attorney, Agent, or Firm*—Ladas & Parry

(57) ABSTRACT

An illumination device is provided on the back surface side of the bath tab vessel for receiving water formed of a transparent material or a translucent material. Furthermore, in a bath tab unit having a double-hulled structure consisting of an inner vessel and an outer vessel, the inner vessel is formed of a transparent material or a translucent material, and an illumination device is provided in a space between the inner vessel and the outer vessel.

9 Claims, 9 Drawing Sheets

BATH TAB WITH BUILT-IN ILLUMINATION DEVICE

BACKGROUND OF THE INVENTION

1. Field of the Invention

The present invention relates to a bath tab with a built-in illumination device, and in particular to a bath tab with a built-in illumination device which illuminates inside the bath tab by indirect lighting (viewed from the bathing person) and enables the bathing person to watch images from inside the bath tab, thereby realizing a bathing feel that improves a mental relaxation effect as well as improving attraction.

2. Description of the Prior Art

A conventional bath tab unit has an appearance as shown in FIG. 1, for example, of which cross-section structure along the line Y—Y is shown in FIG. 2. That is, a bath tab 100 having a rectangular shape is adapted to be embedded in a floor surface 110; the bath tab 100 is adapted to be supplied with hot water or water from a feed water port 101; and on the bottom surface of the bath tab 100 is provided a bench portion 102 having a semi-circular shape for a bathing person to sit thereon. In addition, on each side of the bath tab 100 is provided a handle 103 for the bathing person to rest his/her hand thereon, and on one end portion of the bath tab 100 is provided a head rest 104 made of rubber or the like for the bathing person to lay his/her head thereon in contact state.

In an European style bath tab of a relatively shallow depth, an inclined surface (so-called back rest) which inclines from the upper part to the lower part is provided on the inner surface of the bath tab in order to make the bathing position of a bathing person comfortable. In such a general bath tab structure, it is impossible to improve the attraction and to give an upscale image.

In view of the above, a bath tab with an illumination device which illuminates inside the bath tab by a direct light source has appeared in recent years. FIG. 3 shows a bath tab unit 120 in which inside of a bath tab 121 is illuminated, the bath tab unit 120 being so configured that inside of the bath tab 121 is illuminated by a light source 122 by providing the light source 122 such as lamp on the side surface part of the bath tab 121, hollowing a part of wall surface or bottom surface of the bath tab 121 for allowing light transmission, and providing a transparent material (such as lens or glass) 123 on the front side thereof, and that a rigid sealing structure for preventing water (hot water) in the bath tab 121 from causing a leakage of current in the light source 122. When the light source 122 is turned ON with a switch (not shown), the inside of the bath tab 121 is brightly illuminated.

In the above-described conventional bath tab with the built-in illumination device 120, however, since there is a hollowed part in the wall of the bath tab for enabling light transmission, it is necessary to provide sealing means for protecting the light source 122 from a leakage of current, and even if such sealing means is provided, the possibility of leakage of current and water due to fatigue with time or the like remains, and constant maintenance inspections are necessary for confirming the safety. Furthermore, because of the direct lighting, there is a problem that eyes of the bathing person are fatigued so that the relax feeling is reduced.

SUMMARY OF THE INVENTION

The present invention was made in view of the above-mentioned problems, and it is an object of the present invention to provide a bath tab with a built-in illumination device which illuminates inside the bath tab by indirect lighting of soft feeling (such as monochromatic light, color light, image), thereby improving a mental relax feel of a user and giving an upscale image.

The present invention relates to a bath tab with a built-in illumination device, and the above-mentioned object of the present invention is achieved by providing an illumination device on the back surface side of a bath tab vessel for receiving water formed of a transparent material or a translucent material.

Also, the present invention relates to a bath tab unit of double-hulled structure consisting of an inner vessel and an outer vessel, and the above-mentioned object of the present invention is achieved by forming the inner vessel of a transparent material or a translucent material, and providing an illumination device in a space between the inner vessel and the outer vessel.

DESCRIPTION OF THE PREFERRED EMBODIMENTS

In a bath tab with a built-in illumination device according to the present invention, an illumination device is provided in a space on the back surface side of a bath tab vessel for receiving water formed of a transparent material or a translucent material. The transparent material or the translucent material may form the whole or part of the surface of the bath tab vessel. And, the illumination deice is adapted to illuminate a part or the whole of the back surface of the bath tab vessel to allow the light to transmits through the wall of the bath tab vessel and reach inside of the bath tab, thereby improving the relaxation effect by the light.

Furthermore, the bath tab with a built-in illumination device according to the present invention has a double-hulled structure consisting of an inner vessel and an outer vessel, and between the inner vessel and the outer vessel is provided a space capable of providing an illumination device such as light source. The inner vessel is formed of a plastic material of a transparent material or a translucent material, and the outer vessel is formed of a thermosetting material. The double-hulled structure consisting of the inner vessel and the outer vessel can be produced by a molding process called a vacuum molding, for example. Then, the illumination device such as lamp or light emitting diode is provided in a space between the inner vessel and the outer vessel, or in other words, the illumination device is attached to an inner surface of the outer vessel, whereby the whole or a part of the inner vessel is illuminated. Of course, the illumination device may be attached to a back-surface of the inner vessel. As the illumination device, combination of a light source such as lamp or light emitting diode and an auxiliary material such as optical fiber or fluorescent member will realize more effective illumination.

For this reason, according to the present invention, it is not necessary to take measures against leakage accidents of the illumination device, and it is possible to give a smart upscale image by soft indirect lighting and accordingly give a relaxation feeling by the light to the bathing person.

In the following, embodiments of the present invention will be described with reference to the drawings.

Figure 4:
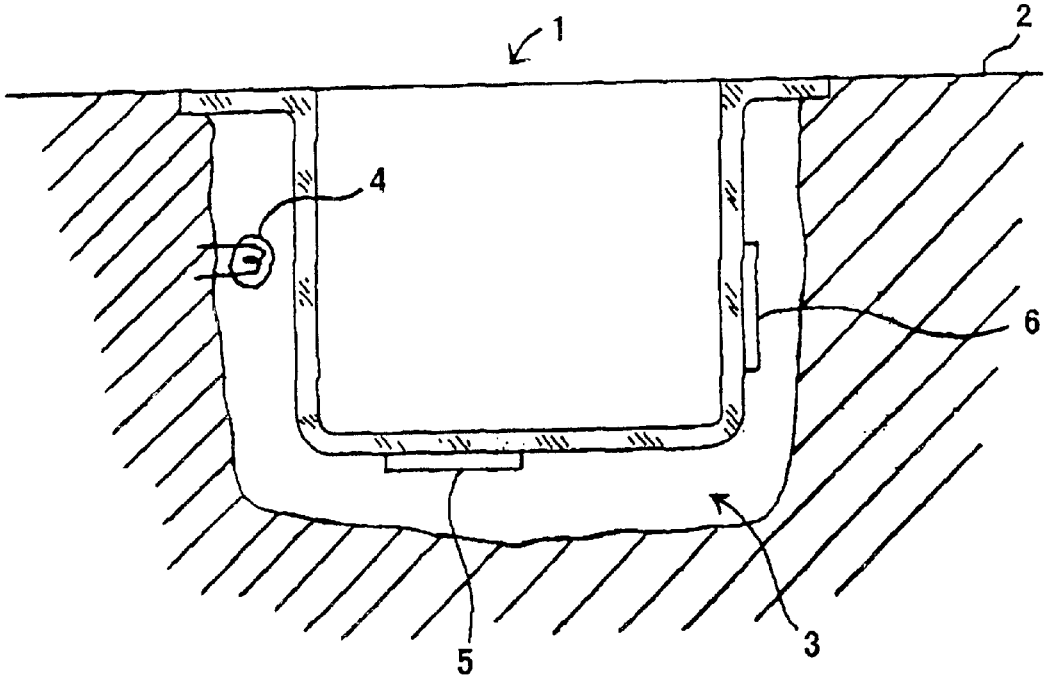
FIG. 4 is a section structural view showing one example of a bath tab with a built-in illumination device according to the present invention.

FIG. 4 is a section view of one embodiment of the present invention, wherein a bath tab vessel 1 for receiving water formed of a transparent material or a translucent material is embedded in a floor 2, and on the rear surface (back surface) side of the bath tab vessel 1 is provided a space 3 which is sufficient to provide an illumination device. The material of the bath tab vessel 1 may be a plastic material or a thermosetting material.

Figure 1:
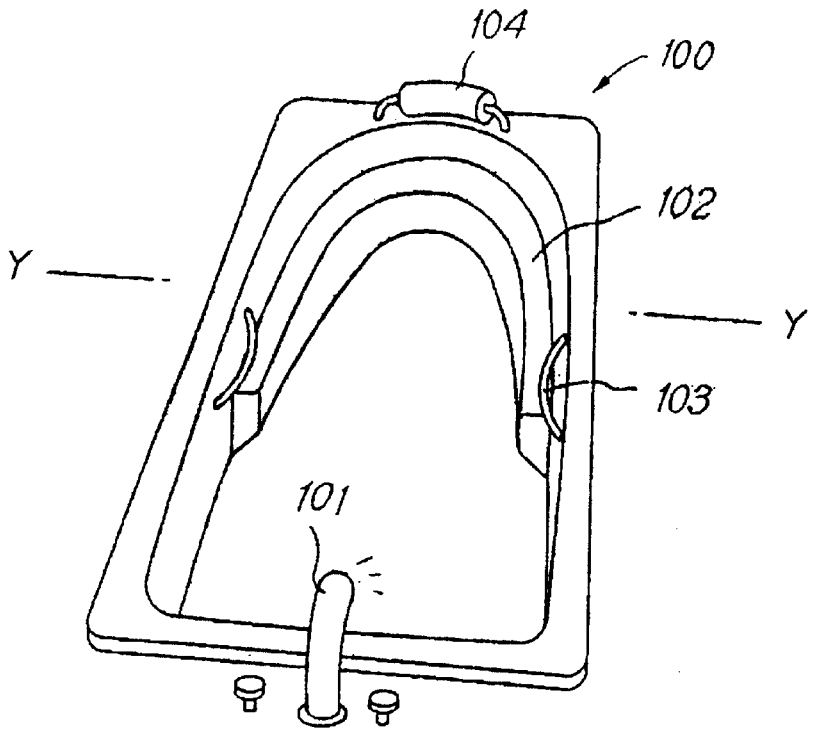
FIG. 1 PRIOR ART
FIG. 1 is an appearance view showing an example of a conventional general bath tab unit.
Figure 2:
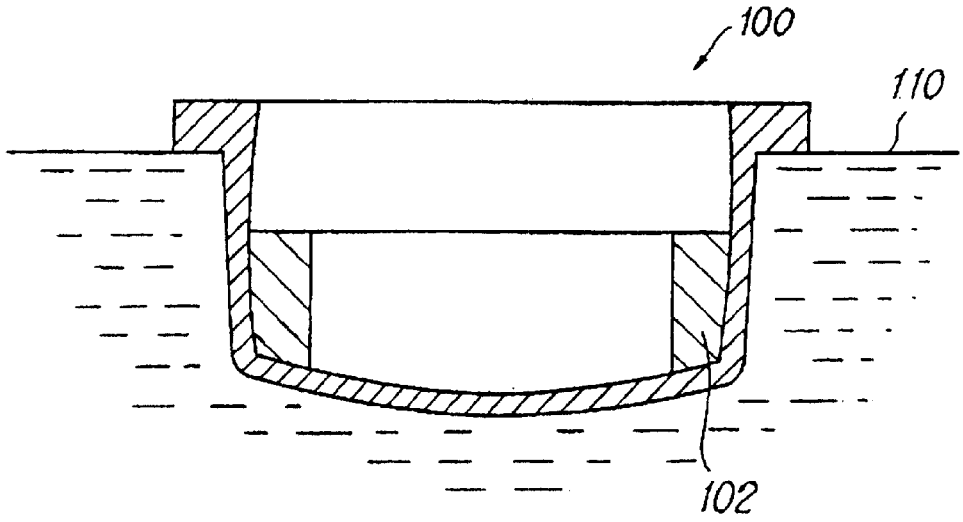
FIG. 2 PRIOR ART
FIG. 2 is a section structural view along the line Y—Y of FIG. 1.
Figure 3:
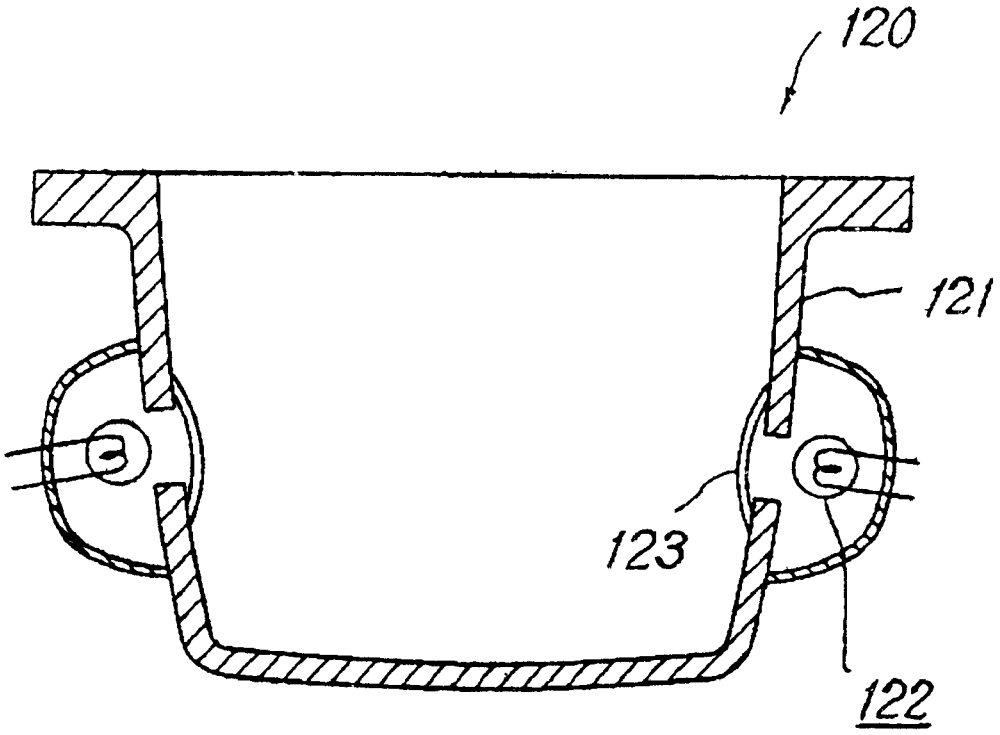
FIG. 3 PRIOR ART
FIG. 3 is a section structural view showing one example of a conventional bath tab with a built-in illumination device.

Then, a lamp (including a fluorescent lamp) 4 is provided in the space 3 so as to enable ON/OFF-control of illumination from outside. When the lamp 4 illuminates, the light reaches inside the bath tab through the wall portion of the bath tab vessel 1 so that water shines. Furthermore, on the back surface of the bath tab vessel 1, a liquid crystal 5 may be bonded and an LED 6 may be provided. Additionally, it is possible to illuminate a part of or the whole surface of the back surface of the bath tab vessel 1 by combining an optical fiber. Though in FIG. 1, the lamp 4, the liquid crystal 5 and the LED 6 are provided in combination, it is also possible to provide each device separately.

Figure 5:
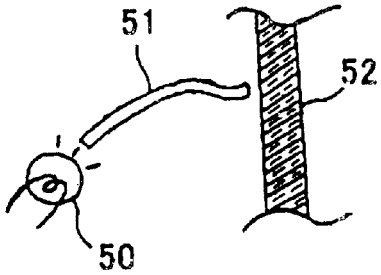
FIG. 5 is a configuration view showing one example in which the illumination device is configured by a lamp and an optical fiber.
Figure 6:
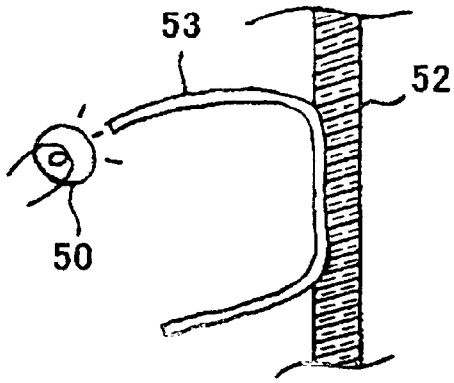
FIG. 6 is a configuration view showing another example in which the illumination device is configured by a lamp and an optical fiber.
Figure 7:
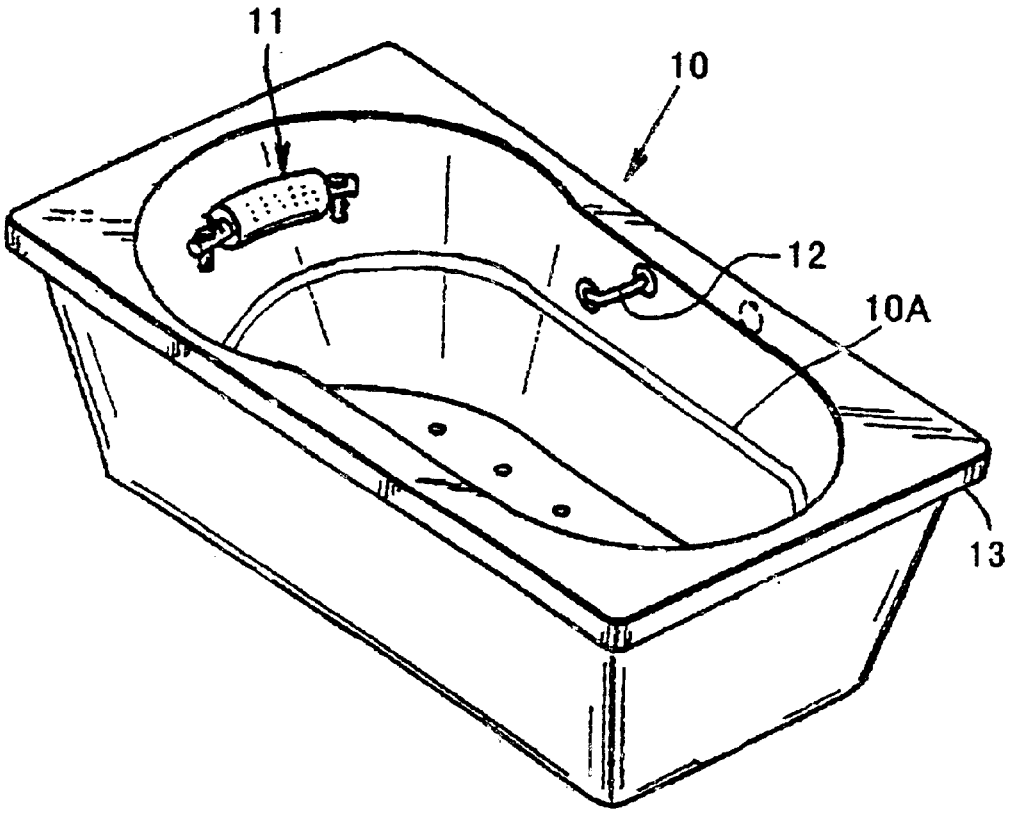
FIG. 7 is a perspective structural view showing one example of the bath tab with a built-in illumination device according to the present invention.

In the case where illumination is achieved by combining an optical fiber and a light source such as lamp, as shown in FIG. 5, an optical fiber 51 transmits the illumination light of a lamp 50 to a bath tab wall 52, and the tip end portion of the optical fiber 51 illuminates the bath tab wall 52. Furthermore, the example shown in FIG. 6 shows the case where illumination is achieved on the side surface part of an optical fiber 53. In the case of illuminating by the side surface part of the optical fiber 53, as shown in FIG. 7, a round-sliced side surface portion 10A of the bath tab 10 is formed of a transparent material or a translucent material and the optical fiber 53 is provided on the back surface of the round-sliced side surface portion 10A. Though the round-sliced side surface portion 10A is configured by one step in the configuration of FIG. 7, the number of steps can be arbitrarily selected. Furthermore, in the present example, the bath tab 10 is provided with a head rest 11 of a bent shape on which the head of a bathing parson will contact, and a handle 12 on which a bathing person will rest his/her hand, however, these are optionally provided and other members (for example, jet nozzle) may be provided.

Figure 8:
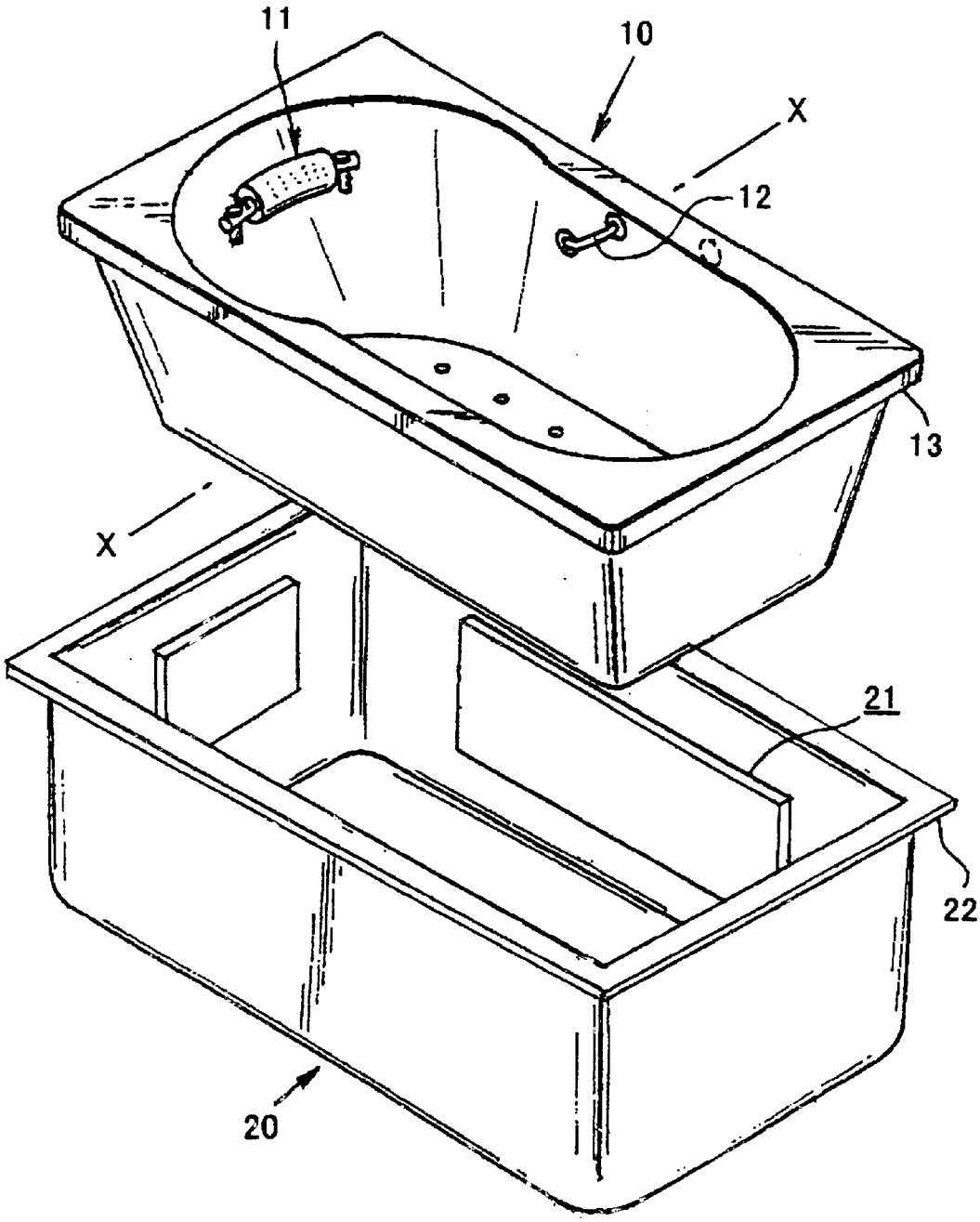
FIG. 8 is a assembly view of another configuration example of the bath tab with a built-in illumination device according to the present invention.

FIG. 8 shows a structural example of other embodiment of the present invention, which comprises an inner vessel 10 formed of a translucent material of plastic material (for example, acrylic or methacrylic resin, polystyrene), and an outer vessel 20 formed of a thermosetting material (for example, formaldehyde resin (phenol resin, urea resin, melamine resin), crosslinked resin (unsaturated polyester resin, diallyl phthalate resin, alkyd resin, epoxy resin)), and in the present example, the head rest 11 for the bathing person to lay his/her head in contact state, and the handle 12 for the bathing person to rest his/her hand are provided inside the inner vessel 10. The inner vessel 10 may be formed of a transparent material (for example, resin or polyethylene containing foams in transparent material).

The size of the inner vessel 10 is smaller than that of the outer vessel 20 so that the inner vessel 10 can be engaged in the outer vessel 20 with some margin. Furthermore, on the top surface of the inner vessel 10 is provided a collar 13 in a surrounding manner, and also on the top surface of the outer vessel 20 is provided a collar 22 so that the lower surface of the collar 13 and the upper surface of the collar 22 come close contact with each other when they are engaged with each other. The bath tab having such a double-hulled structure can be produced by vacuum molding. In addition, on the inner surface (four side surfaces and bottom surface) of the outer vessel 20, an EL (Electro Luminescence) 21 having a plane structure is provided as an illumination device so as to be driven (turned ON/OFF) by an external power supply apparatus (not shown).

Figure 9:
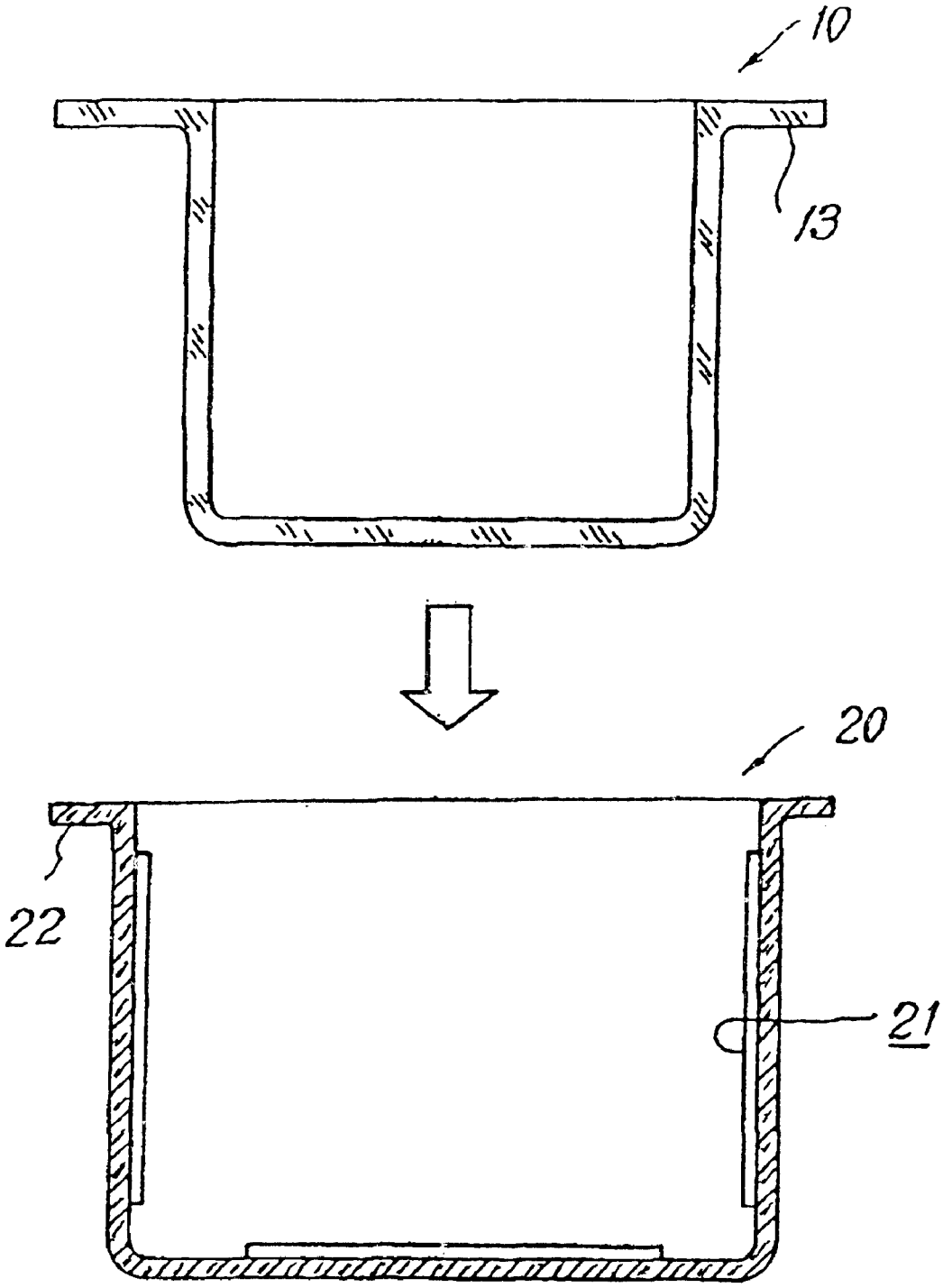
FIG. 9 is a section configuration view along the line X—X in FIG. 8.
Figure 10:
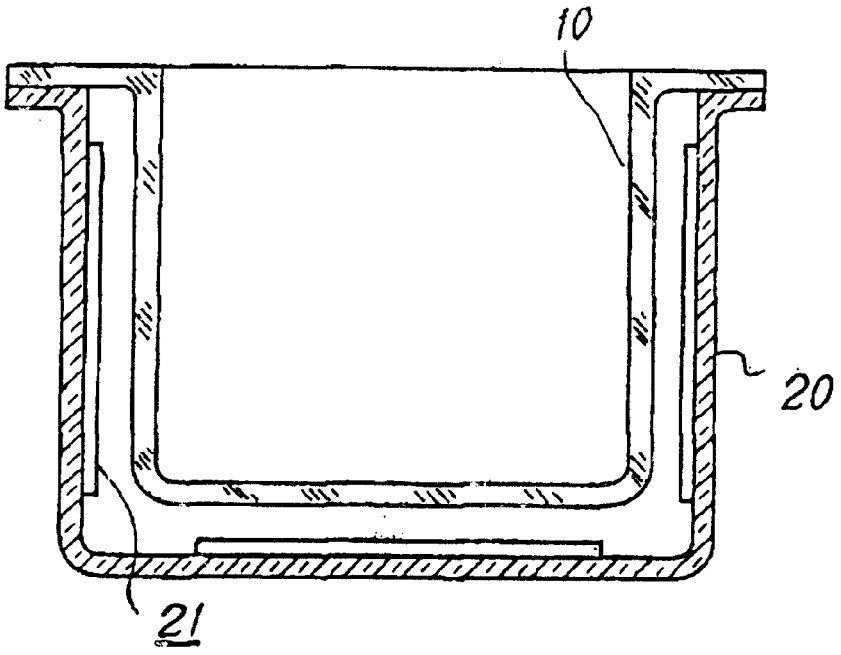
FIG. 10 is a section configuration view of the bath tab with a built-in illumination device according to the present invention.

The cross section structure of the inner vessel 10 and the outer vessel 20 along the line X—X of FIG. 8 is shown in FIG. 9, and the state that the inner vessel 10 and the outer vessel 20 are engaged with each other is shown in FIG. 10. Since the size of the outer vessel 20 is larger than that of the inner vessel 10, a space is formed between the inner vessel 10 and the outer vessel 20, in which the EL 21 can be provided.

As for the bath tab unit in the state as shown in FIG. 10, since the EL 21 is driven and turned ON by means of the power supply apparatus, the illumination light gives optical changes and intonations via the translucent inner vessel 10 and hence via the water (hot water) filled in the inner vessel 10, with the result that it is possible to improve the attraction of the bath tab unit, as well as give an upscale image by improving relaxation by the light. The EL 21 may be controlled so as to repeat turning ON/OFF of the illumination in place of continuous illumination.

Figure 11:
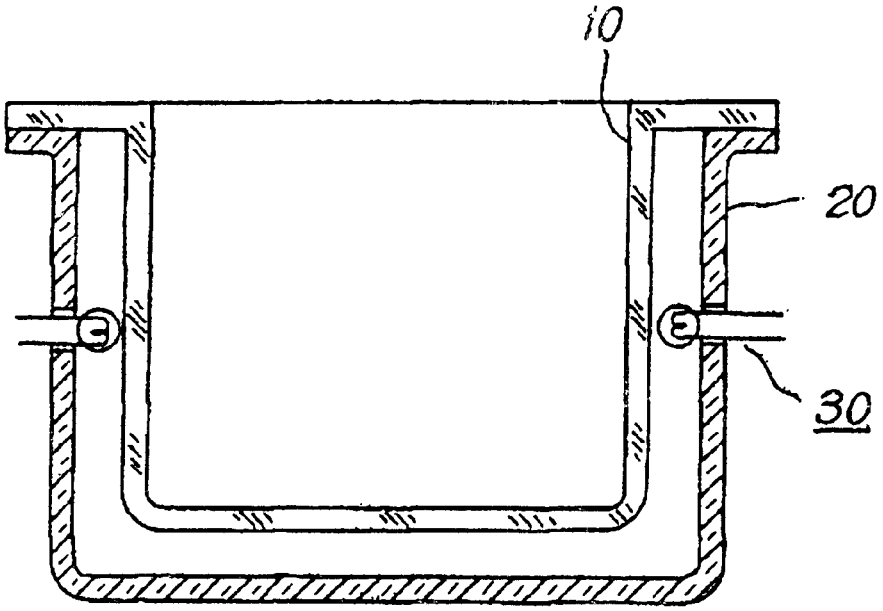
FIG. 11 is a section structural view showing yet another example of the bath tab with a built-in illumination device according to the present invention.

In the above example, the case where the EL of a plane structure is used as the illumination device, however, it is also possible to illuminate the inner vessel 10 by using a lamp (including a fluorescent lamp) 30 as shown in FIG. 11. The lamp 30 can be provided on the bottom surface of the outer vessel 20. By arranging a color filter on the front surface of each of plurality of lamps 30, it is also possible to illuminate by color lights, or give a change to illumination by controlling ON/OFF of the lamp 30.

Figure 12:
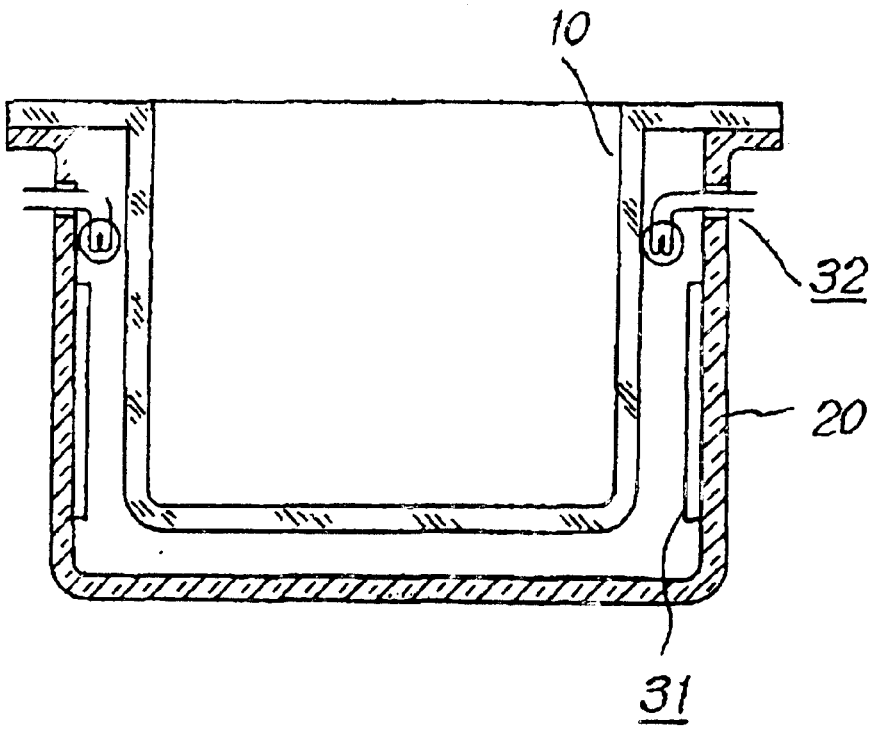
FIG. 12 is a section structural view showing yet another example of the bath tab with a built-in illumination device according to the present invention.

Furthermore, it is also possible to bond a fluorescent member 31 having a plane structure on the inner side of the outer vessel 20 as shown in FIG. 12, and thereby illuminate the fluorescent member 31 with a lamp 32. In such a case, since fluorescence is emitted by the fluorescent member 31 when the lamp 32 is turned off after illumination of the lamp 32, it is possible to illuminate the bath tab with week light. Though not shown in the drawing, it is also possible to carry out wiring with an optical fiber between the lamp 32 and the fluorescent member 31, thereby illuminating the fluorescent member 31 by the output light from the optical fiber.

Figure 13:
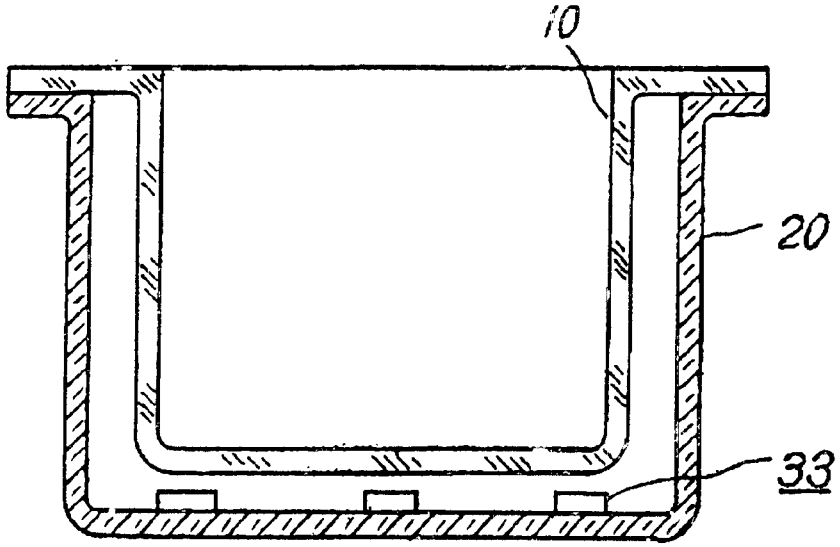
FIG. 13 is a section structural view showing yet another example of the bath tab with a built-in illumination device according to the present invention.

Furthermore, FIG. 13 shows an example where LEDs (Light Emitting Diodes) 33 are arranged in plural positions on the bottom surface of the outer vessel 20, and when LEDs of three colors, R, G, B are disposed in each position, by controlling ON/OFF and light emission amount of the plurality of LEDs, it is possible to illuminate the bottom surface of the bath tab with multicolor lights. In connection with this, the LEDs 33 are ON/OFF controlled by remote control by a driving apparatus (not shown), and the LEDs 33 may be provided on the inner side surface of the outer vessel 20.

Figure 14:
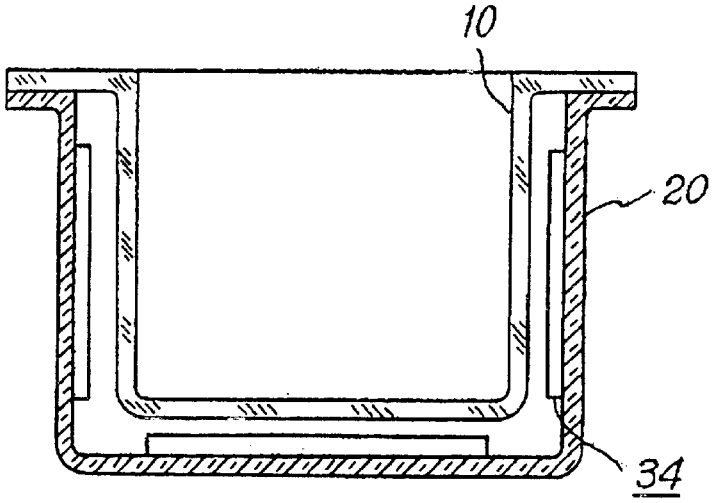
FIG. 14 is a section structural view showing yet another example of the bath tab with a built-in illumination device according to the present invention.

On the other hand, in FIG. 14, the whole inner surface (four side surfaces and bottom surface) of the outer vessel 20 is covered with a color liquid crystal display 34, and the color liquid crystal display 34 is connected with an image display/control device (not shown). This enables display of a color image on the color liquid crystal display 34, making it possible for the bathing person to watch a moving image or still image while bathing. According to the present example, it is possible to obtain a dynamic live effect due to pictures, as well as the illumination as described above.

Figure 15:
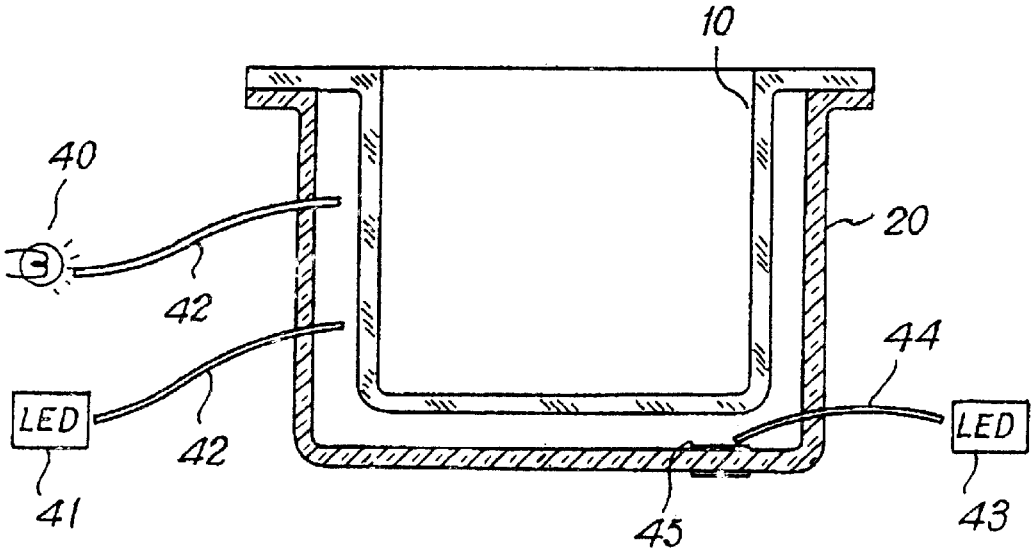
FIG. 15 is a section structural view showing yet another example of the bath tab with a built-in illumination device according to the present invention.

Furthermore, FIG. 15 shows an alternative example of the present invention, in which it is also possible to introduce illumination light of a lamp 40 or an LED 41 provided outside to the interior of the inner vessel 10 via an optical fiber 42, thereby illuminating inside the inner vessel 10 by means of the optical fiber 42. Furthermore, it is also possible to introduce illumination light of an LED 43 to the interior via an optical fiber 44, thereby illuminating a fluorescent member 45 bonded on the outer vessel 20 with output light from the optical fiber 44.

In the above embodiments, a lamp (including the fluorescent lamp), an EL, an LED and a liquid crystal display are exemplified as the illumination device, any devices are applicable so far as they emit light or image. Furthermore, also the shape and structure of the bath tab vessel, the shape and the number of illumination device and the like are not limited to the above examples. The switch, control device and the like of the illumination device may be arranged so as to be operable while sitting on the bath tab or from outside.

According to the bath tab with a built-in illumination device of the present invention, an illumination device (including an image display) such as lamp, light emitting diode or the like is provided on the back surface side of a bath tab for receiving water formed of a transparent material or a translucent material, thereby illuminating a part or the whole of the bath tab. Furthermore, in another example, the bath tab has a double-hulled structure consisting of an inner vessel formed of a transparent material or a translucent material and an outer vessel, an illumination device (including image display) such as lamp, light emitting diode or the like is provided in a space between the inner vessel and the outer vessel, and an optical fiber, a fluorescent member and the like are combined as necessary, thereby illuminating a part or the whole of the surface of the inner vessel.

For this reason, according to the present invention, it is possible to give a deep relaxation and a satisfied feel to the bathing person without taking measures against a leakage accident for the light source and without fatiguing the eyes of the bathing person because the illumination is realized by indirect lighting.

What is claimed is:

1. A bath tab with a built-in illumination device having a double-hulled structure consisting of an inner vessel which forms a bath tab and receives water and an outer vessel, wherein the inner vessel is formed of a transparent material or a translucent material, and an illumination device is provided in a space between the inner vessel and the outer vessel.

2. A bath tab with a built-in illumination device according to claim 1, wherein the illumination device is attached to the outer vessel so as to illuminate the whole surface of the inner vessel.

3. A bath tab with a built-in illumination device according to claim 2, wherein the illumination device is a liquid crystal display for displaying color images.

4. A bath tab with a built-in illumination device according to claim 2, wherein the illumination device is a lamp.

5. A bath tab with a built-in illumination device according to claim 2, wherein the illumination device is a light emitting diode.

6. A bath tab with a built-in illumination device according to claim 2, wherein the illumination device is a combination of a light emitting diode and an optical fiber.

7. A bath tab with a built-in illumination device according to claim 2, wherein the illumination device is a combination of a light source and a fluorescent member.

8. A bath tab with a built-in illumination device according to claim 7 further comprising an optical fiber.

9. A bath tub with a built-in illumination device according to claim 1, wherein the illumination device is attached to the outer vessel so as to illuminate a part of the inner vessel.

* * * * *

UNITED STATES PATENT AND TRADEMARK OFFICE

CERTIFICATE OF CORRECTION

PATENT NO. : 6,539,561 B2
DATED : April 1, 2003
INVENTOR(S) : Hideo Shimizu

It is certified that error appears in the above-identified patent and that said Letters Patent is hereby corrected as shown below:

Title page,
Item [54], Title, should read -- BATH TUB WITH BUILT-IN ILLUMINATION DEVICE --
Item [57], ABSTRACT,
Lines 1-8, please replace the original ABSTRACT with the following:
-- An illumination device is provided on the back surface side of the bath tub vessel for receiving water formed of a transparent material or a translucent material. Furthermore, in a bath tub unit having a double-hulled structure consisting of an inner vessel and an outer vessel, the inner vessel is formed of a transparent material or a translucent material, and an illumination device is provided in a space between the inner vessel and the outer vessel. --

Column 1,
Lines 1, 8, 9, 11, 13, 17, 19, 21, 23, 25, 27, 31 and 34, change “bath tab” to -- bath tub --.
Lines 36, 38, 39, 40, 41, 42, 42-43, 45, 46, 49, 52, 53 and 55, change “bath tab” to -- bath tub --.

Column 2,
Lines 1, 2, 6, 9, 12, 22, 26, 29 and 38, change “bath tab” to -- bath tub --.
Lines 41, 45, 49, 52, 55, 58, 61 and 66, change “bath tab” to -- bath tub --.

Column 3,
Lines 1, 5, 6-7, 8, 10, 40 and 43, change “bath tab” to -- bath tub --.
Lines 45, 50, 51, 52, 55, 62 and 63, change “bath tab” to -- bath tub --.

Column 4,
Lines 1, 8, 35, 51 and 57, change “bath tab” to -- bath tub --.

Column 5,
Lines 9, 21, 50 and 54, change “bath tab” to -- bath tub --.

UNITED STATES PATENT AND TRADEMARK OFFICE

CERTIFICATE OF CORRECTION

PATENT NO. : 6,539,561 B2
DATED : April 1, 2003
INVENTOR(S) : Hideo Shimizu

It is certified that error appears in the above-identified patent and that said Letters Patent is hereby corrected as shown below:

Column 6,
Lines 1, 5, 7, 8, 24, 26, 31, 35 and 38, change “bath tab” to -- bath tub --.
Lines 40, 43, 46, 49 and 51, change “bath tab” to -- bath tub --.

Signed and Sealed this

Twentieth Day of January, 2004

JON W. DUDAS
*Acting Director of the United States Patent and Trademark Office*